US007346147B2

(12) United States Patent
Kirk et al.

(10) Patent No.: US 7,346,147 B2
(45) Date of Patent: Mar. 18, 2008

(54) X-RAY TUBE WITH CYLINDRICAL ANODE

(76) Inventors: Randol E. Kirk, 1517 Bryn Mawr Dr., Albuquerque, NM (US) 87106; Daniel F. Gorzen, 1980 E. Michigan Ave., Ypsilanti, MI (US) 48198

( * ) Notice: Subject to any disclaimer, the term of this patent is extended or adjusted under 35 U.S.C. 154(b) by 365 days.

(21) Appl. No.: 11/190,985

(22) Filed: Jul. 27, 2005

(65) Prior Publication Data

US 2007/0025515 A1 Feb. 1, 2007

(51) Int. Cl.
*H01J 35/06* (2006.01)
*H01J 35/08* (2006.01)

(52) U.S. Cl. ..... 378/136; 378/121; 378/143

(58) Field of Classification Search ..... 378/121, 378/119, 136, 143
See application file for complete search history.

(56) References Cited

U.S. PATENT DOCUMENTS 5,504,799 A * 4/1996 Suzuki ..... 378/121
2004/0165699 A1* 8/2004 Rusch et al. ..... 378/119

* cited by examiner

*Primary Examiner*—Chih-Cheng G Kao
(74) *Attorney, Agent, or Firm*—Leo J. Aubel

(57) ABSTRACT

A linear source of x-rays is disclosed wherein an elongated filament, mounted within a cylindrically formed anode, provides electrons around the filament, and along the length of said filament. The anode that comprises a high Z material such as gold, receives the electrons and emits X-rays in a 360 degree arc and along a substantial length of the anode. In one embodiment the tube is used for irradiation purposes.

7 Claims, 1 Drawing Sheet

X-RAY TUBE WITH CYLINDRICAL ANODE

BACKGROUND OF INVENTION

This patent application relates to apparatus wherein electrons bombard a transmission type target to develop X-rays that exit the opposite side of the target. Such transmission type targets are described in, for example, U.S. Patent Application Publication No. 2002/0064253.

It is an object of the present invention to provide an X-ray tube having an elongated filament and a cylindrically shaped anode resulting in an X-ray tube that is much improved in power and efficiency over the prior art transmission type anodes.

SUMMARY OF INVENTION

A source of X-ray beams is disclosed wherein the radiation field is developed by an elongated filament and a cylindrically shaped transmission type anode. The filament is mounted along the axis of the cylindrically shaped anode. The material of the anode and the energy of the electrons are selected to provide an anode wherein a majority of the electrons impinging on the interior surface of the anode are converted to X-rays which then penetrate the material of the anode and exit the anode. A portion of the electrons generate X-rays at the anode that are reflected from the anode and can be directed toward the target. The result is a linear source of X-rays providing high energy.

The foregoing features and advantages of the present invention will be apparent from the following more particular description of the invention. The accompanying drawings, listed herein below, are useful in explaining the invention.

DESCRIPTION OF INVENTION

Figure 1:
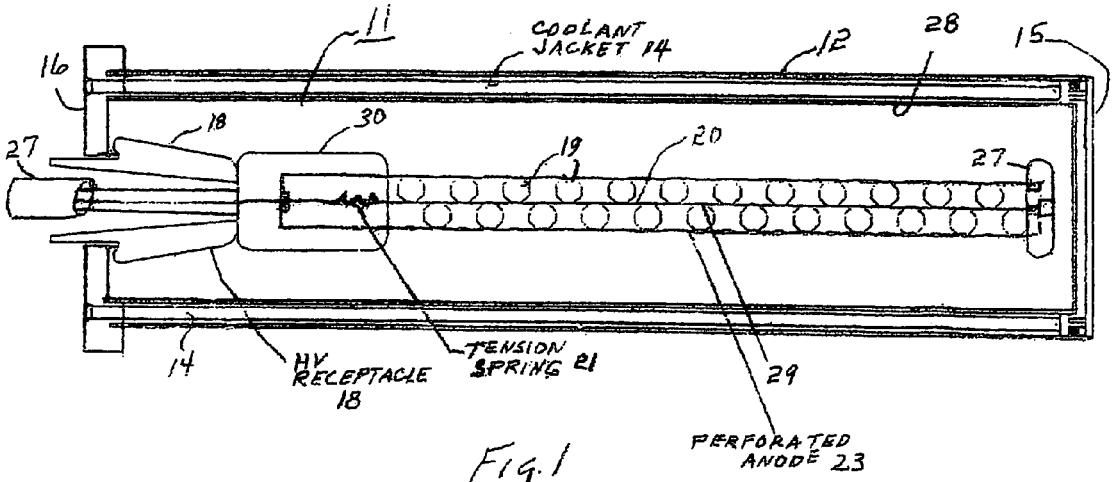
FIG. 1 is a drawing of the inventive X-ray tube.
Figure 2:
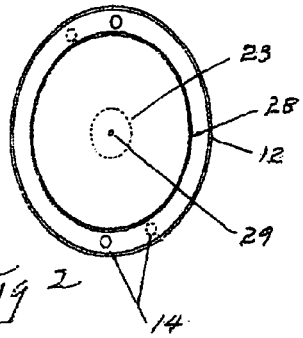
FIG. 2 is a sketch of a cross sectional of the tube.

Refer first to FIG. 1, which shows one embodiment of an X-ray source or tube 11. Tube 11 comprises an outer cylinder-shaped housing 12 (see also FIG. 2) having a cap 15 suitably sealing one end of the housing. A second or flange end 16 of housing 12 receives a high voltage receptacle 18, of suitable known design. A second interior cylinder 28 is mounted within housing 12. The cylinder 28 is sealed at both ends to provided a closed member of minimum thickness and strength to enable the cylinder 28 to maintain a suitable vacuum, such as is known for high power vacuum tubes. A liquid coolant is provided to the tube 11 through a jacket 14 between cylinder 28 and housing 12.

The insulated high voltage receptacle 18 that is mounted on flange 16 receives the high voltage for powering the tube 12. In one embodiment, a suitable known type power supply, not shown, supplies 160 kV at 20 ma to the tube through cable 27.

A cathode support assembly 30 mounted at the end of receptacle 18 support an elongated and perforated anode 23, in the form of a cylinder. Anode 23 is mounted to extend from the cathode support 30 along the axis of cylinder 28.

Perforations 19 in anode 23 are formed along the length of the anode. The free end of anode 23 is affixed onto a corona shield 27.

In one embodiment, the cylindrical anode 23 is formed of a layer of high Z (atomic number) material 31 such as gold, of about 10 microns thickness, that is deposited onto a surface of an aluminum outer layer of about 4 mils thickness. Other high Z material may be used in lieu of gold. A tungsten filament 29 is mounted on cathode support 30 and extends along the axis of anode 23. The base or cathode end of the filament 29 is connected through a tension spring 21 to the cathode support 30, and the other or free end of the filament is connected to a corona shield 27. Tension spring 21 maintains the filament 29 taut and compensates for the expansion that occurs when the filament is heated. Power for the filament 20 is provided through the high voltage leads 27.

Figure 3:
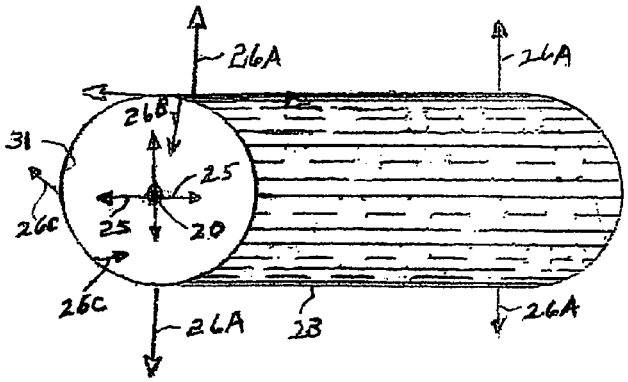
FIG. 3 is a sketch useful in explaining the radiation effect of the cylindrical anode.

Referring now also to FIG. 3, when the tungsten filament 29 is heated, electrons generally labeled 25 are generated. Importantly, the electrons 25 are emitted along substantially the full length of the centrally positioned filament 29. The electrons are emitted in 360 degree circle toward the biased cylindrical anode 23. The burst of a single plane of electrons is indicated in FIG. 3. In response to the electron bombardment, the anode 23 in turn develops X-rays in a 360 degree circle, as depicted in FIG. 3.

The energy of the electrons accelerated toward the anode 23 is correlated to the thickness of the anode material that comprises a gold deposition of 10 to 14 microns thickness on an aluminum material that is 4 mils thick. This factor improves the percentage of the electrons of a chosen acceleration that will convert to X-ray energy in the anode 23, and penetrate and exit the anode. As indicated in FIG. 3, the electrons 25 bombarding the interior gold layer surface of the anode 23 are converted to X-rays 26A which exit or pass through anode 23 while others of the electrons create X-rays 26B that are reflected back toward the axis of the anode and pass through an opposite surface of the anode. Once created, the X-rays can easily pass through the anode 23. Two important occurrence result: a) the creation of X-rays which proceed in a direction through the anode along the effective length of the anode 23, and b) the creation of X-rays which are reflected back occur along the effective length of the anode 23 and throughout the 360-degree circumference of the cylindrical anode, see FIG. 3.

Figure 4:
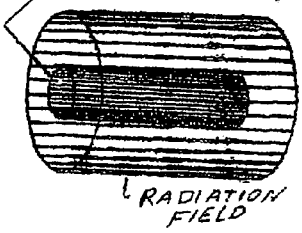
FIG. 4 is a sketch showing the 360 degree radiation field extending along the longitudinal length of the anode.

The filament 20 and the anode 23 are both elongated thereby providing a cylindrical volume of electrons that are generated along the length of the filament. Importantly as mentioned above, this in turn results in a tube wherein X-rays are developed along the length of the anode 23, thereby providing a 360-degree radiation field along the length of the anode, as depicted in FIG. 4.

As stated above, in the inventive tube 11, electrons create X-rays that are emitted in a 360-degree arc from multiple points in the tube cylinder 12. The total dose of X-rays at a selected volume in space outside the tube cylinder will comprise:

1) the forward emission through the anode from a point nearest that target, and
2) an accumulation of X-rays reflected back to the target.

Also, a minor portion of the electrons 25 will create X-rays 26*c* from various other points on the anode surface that will be emitted and/or reflected at various angles; these random X-rays 26*c* will combine with the forward and reflected X-rays energy.

In tests it has been found that the irradiation of a prior art spot beam type system operating a 160 kV, 20 ma tube provided an average of 360 R/min to a 28 square inch target. The inventive tube utilizing a 160 kV, 20 ma power supply provides an average of 3500 R/min to a 62 square inch target which is about a ten (10)times increase in irradiation applied to a target double in size.

While the invention has been particularly shown and described with reference to a particular embodiment thereof it will be understood by those skilled in the art that various changes in form and detail may be made therein without departing from the spirit and scope of the invention.

The invention claimed is:

1. An X-ray tube for providing a source of X-rays to a target, said tube comprising, a) a cylinder-shaped housing;

b) an elongated cathode assembly, an elongated filament and an elongated cylindrical anode concentrically mounted within said housing;

c) a high voltage receptacle for connecting high voltage power to said cathode assembly, filament and anode;

d) said filament comprising an elongated straight linear element and extending along the longitudinal axis of said housing, said cathode and said anode;

e) a tension spring means affixed to one end of the filament for maintaining said filament taut when said filament expands as said filament is heated by a power source;

f) said filament, when energized and heated, providing electrons along its linear length in a 360 degree arc; and g) said anode receiving said electrons and generating X-rays in a 360 degree arc in response to said electrons along the length of said anode.

2. An X-ray tube as in claim 1 wherein said anode is formed of gold and the thickness thereof is selected with reference to the power applied to said anode to maximize the X-ray output of said anode.

3. An X-ray tube as in claim 1 wherein said anode has a thin layer of high Z material deposited on a second layer of a relatively thicker conductive material to cause a major portion of the electrons impinging thereon to convert to X-rays, to pass through said anode, and to exit as X-rays.

4. An X-ray tube as in claim 1 wherein the anode has a layer of gold of about 10-14 microns thickness deposited on a layer of aluminum of about 4 mils thickness to improve the percentage of electrons that convert to X-ray energy in the anode and exit the anode.

5. An X-ray tube as in claim 1 wherein the tube is operable from 160 kV, 20 ma a power source said tube having the potential to produce photons that penetrate the wall of the tube and exit into free space toward a target from multiple points in said tube, said X-rays comprising the forward emission through the anode from a point nearest the target and X-rays reflected back to the target, and a cooling apparatus within said housing.

6. An X-ray tube as in claim 1 including a liquid cooling jacket mounted within the housing and extending the full length of said anode to provide a cooling effect.

7. An X-ray tube as in claim 1 including a support for said filament.

* * * * *